US009396709B2

(12) United States Patent
Eyman

(10) Patent No.: US 9,396,709 B2
(45) Date of Patent: Jul. 19, 2016

(54) HEADSTOCK FOR STRINGED INSTRUMENT

(71) Applicant: Richard E. Eyman, Manheim, PA (US)

(72) Inventor: Richard E. Eyman, Manheim, PA (US)

( * ) Notice: Subject to any disclaimer, the term of this patent is extended or adjusted under 35 U.S.C. 154(b) by 0 days.

(21) Appl. No.: 14/887,456

(22) Filed: Oct. 20, 2015

(65) Prior Publication Data

US 2016/0118027 A1 Apr. 28, 2016

Related U.S. Application Data

(60) Provisional application No. 62/067,102, filed on Oct. 22, 2014.

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS 2,260,049 A * 10/1941 Nickel, Jr. ..... G10D 3/14 254/13
4,452,120 A * 6/1984 Chance ..... G10D 3/14 84/306
D286,892 S 11/1986 Kubicki et al.
4,974,481 A 12/1990 Gilbert
5,208,410 A * 5/1993 Foley ..... G10D 3/04 84/298
5,519,165 A 5/1996 Gregory
6,046,393 A 4/2000 Rose
6,372,971 B1 * 4/2002 Rogers ..... G10D 3/04 84/290
6,563,032 B2 5/2003 Gregory
7,332,662 B2 2/2008 Kandrack et al.
7,462,769 B2 12/2008 Kilpatrick
7,560,630 B1 7/2009 Keenan, Jr.
7,659,465 B1 * 2/2010 McEwen ..... G10D 3/14 84/304

FOREIGN PATENT DOCUMENTS

DE 3705625 A1 10/1987

* cited by examiner

*Primary Examiner* — Robert W Horn
(74) *Attorney, Agent, or Firm* — McNees Wallace & Nurick LLC

(57) ABSTRACT

A headstock for use with a stringed instrument. The headstock includes saddle receiving recesses which are positioned proximate openings which extend through a first surface of the headstock toward a second surface of the headstock. Saddles are positioned in the saddle receiving recesses. The saddles extend past the first surface in a direction away from the second surface, wherein the saddles and saddle receiving recesses cooperate with strings of the stringed instrument to direct the path of the strings.

20 Claims, 5 Drawing Sheets

HEADSTOCK FOR STRINGED INSTRUMENT

FIELD OF THE INVENTION

The present invention is directed to headstock for stringed musical instruments. In particular, the invention is directed to headstock which uses one or more saddles for the purpose of guiding one or more strings without the need for slots in the headstock of the instrument.

BACKGROUND OF THE INVENTION

Stringed instruments, such as guitars, have had the same configuration for many years. In known guitars, the headstock is located at the end of the guitar neck farthest from the body. It is fitted with tuner posts that adjust the tension of the strings, which in turn affects the pitch. One traditional tuner layout is "3+3", in which each side of the headstock has three tuner posts or tuners. In many applications, the strings extend from the nut of the guitar to the tuners which are positioned in slots. However, the slots provide structural limitations to the head or headstock.

It would, therefore, be beneficial to provide a headstock in which the traditional structural limitations are eliminated.

SUMMARY OF THE INVENTION

An object of the invention is to provide headstock in which slotting is not required.

An object of the invention is to provide additional headstock shapes which can be used with standard slotted headstock type tuning machines without sacrificing structured integrity of the headstock.

An object of the invention is to provide headstock with removable saddles which permits easy adjustment and replacement of the saddles.

An object of the invention is to provide headstock which can be used with any number of strings and which can be used with as a straight or angled headstock.

An object of the invention is to provide headstock which allows for unlimited location possibilities of unusual shapes otherwise impossible with conventional headstock slots.

An object of the invention is to provide headstock with increased strength of which is less vulnerable from side impacts.

An object of the invention is that a tuner mechanism exerts a much more positive down tension on the string as it travels over the string guide or nut due to the inset position of the post of the tuner mechanism in the headstock, thereby eliminating the need for any ancillary string tensioning devices commonly used.

An embodiment is directed to a headstock for use with a stringed instrument. The headstock includes saddle receiving recesses which are positioned proximate openings which extend through a first surface of the headstock toward a second surface of the headstock. Saddles are positioned in the saddle receiving recesses. The saddles extend past the first surface in a direction away from the second surface. Wherein the saddles and saddle receiving recesses cooperate with strings of the stringed instrument to direct the path of the strings.

An embodiment is directed to a headstock for use with a stringed instrument. The headstock includes saddle receiving recesses which are positioned proximate openings which extend through a first surface of the headstock toward a second surface of the headstock. Saddles are positioned in the saddle receiving recesses. The saddles extend past the first surface in a direction away from the second surface. Tuner mechanisms extend into the openings to cooperate with strings of the stringed instrument, wherein the saddles and saddle receiving recesses cooperate with the strings to direct the path of the strings.

An embodiment is directed to a headstock for use with a stringed instrument. The headstock includes saddle receiving recesses which are positioned proximate openings which extend through a first surface of the headstock toward a second surface of the headstock. Saddles are positioned in the saddle receiving recesses. The saddles extend past the first surface in a direction away from the second surface. Tuner mechanisms extend into the openings to cooperate with strings of the stringed instrument. The tuner mechanisms are mounted through sides of the headstock. Wherein the saddles and saddle receiving recesses cooperate with the strings to direct the path of the strings.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
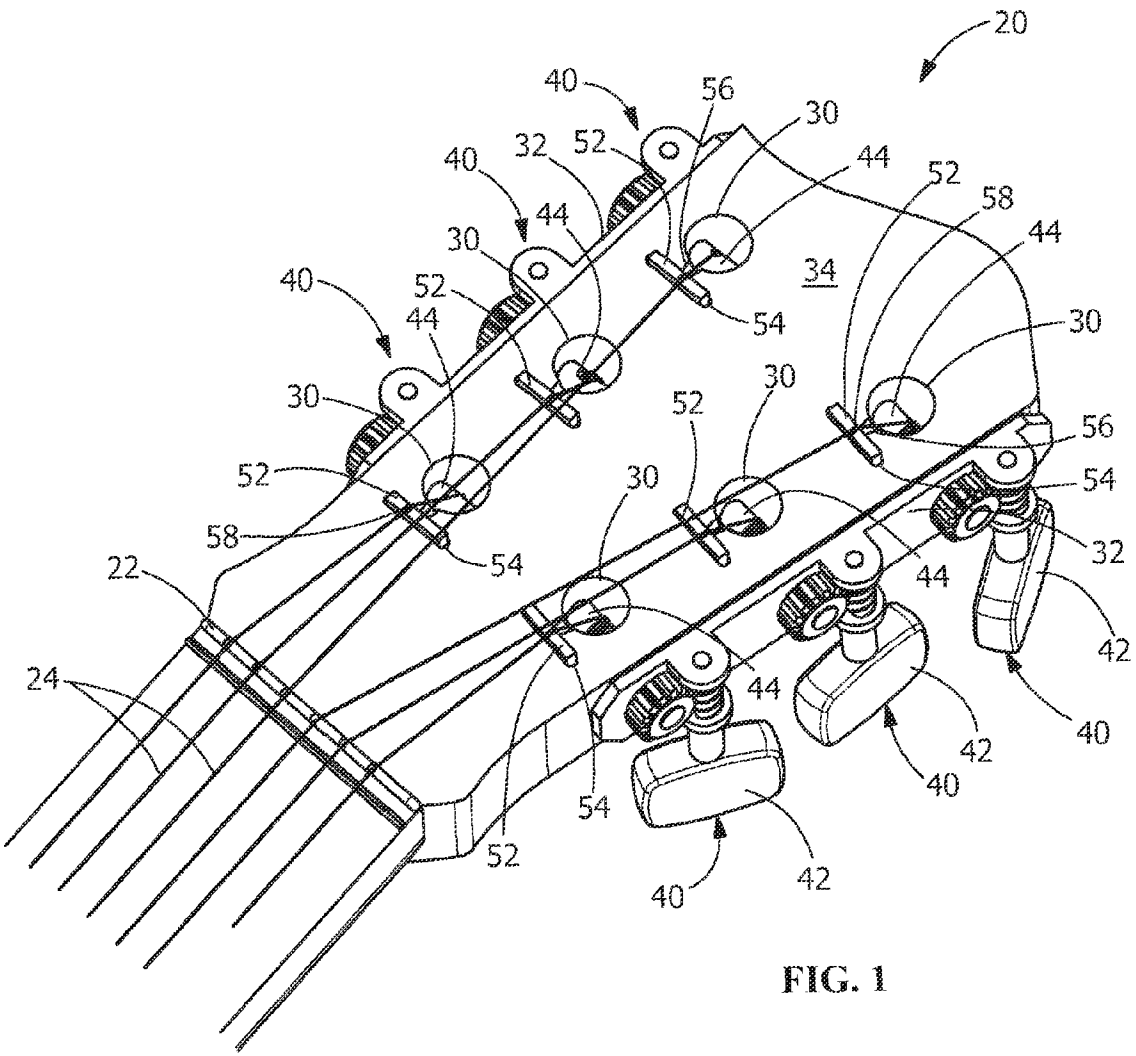
FIG. 1 is a top perspective view of an illustrative headstock according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "horizontal," "vertical," "top" and "bottom" as well as derivative thereof should be construed to refer to the orientation as then described or as shown in the drawing under discussion. These relative terms are for convenience of description only and do not require that the apparatus be constructed or operated in a particular orientation unless explicitly indicated as such. Terms such as "attached," "positioned in and similar terms refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the illustrative embodiments. Accordingly, the invention expressly should not be limited to such embodiments illustrating some possible non-limiting combination of features that may exist alone or in other combinations of features, the scope of the invention being defined by the claims appended hereto.

For the remainder of the description, stringed musical instruments in general will be understood as being the general subject matter of the invention. However, for ease of discussion, reference may be made to a specific stringed musical instrument, such as a guitar. This specific reference to a guitar is not meant to limit the scope of the invention.

A guitar generally includes a body, a neck extending forward or distally from the guitar body and a headstock 20 disposed at a distal end of neck. The guitar body, neck, and headstock 20 are typically made of wood, but other materials can be used. A nut 22 is located just proximal or rearward of the headstock 20. The nut 22 is provided so that strings 24 of the guitar can vibrate above the neck on the headstock 20. The strings 24 each comprise a first end which is secured to guitar body in a known manner and a second end secured to the headstock 20 as described herein.

Figure 2:
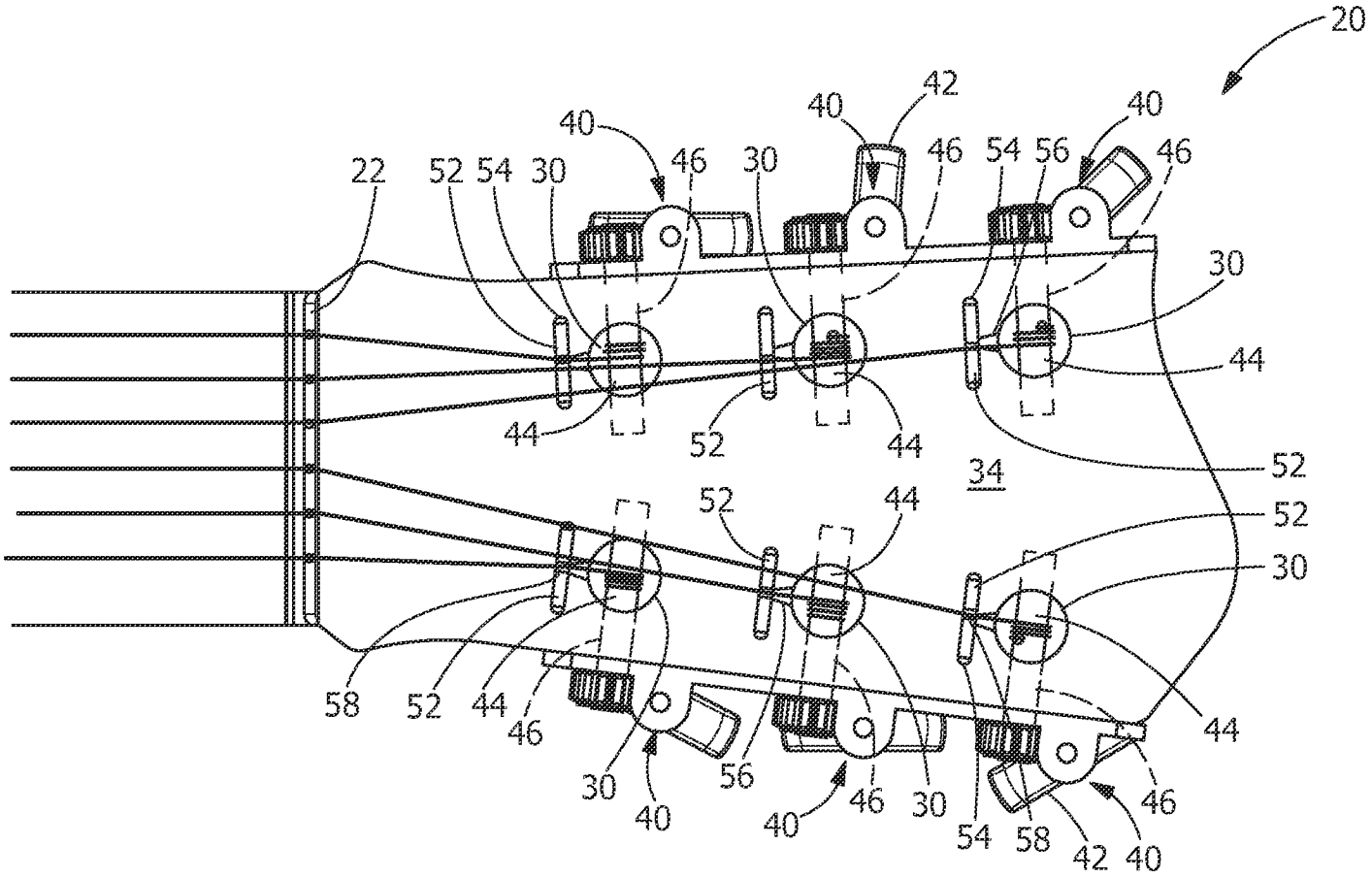
FIG. 2 is a top view of the headstock of FIG. 1.
Figure 3:
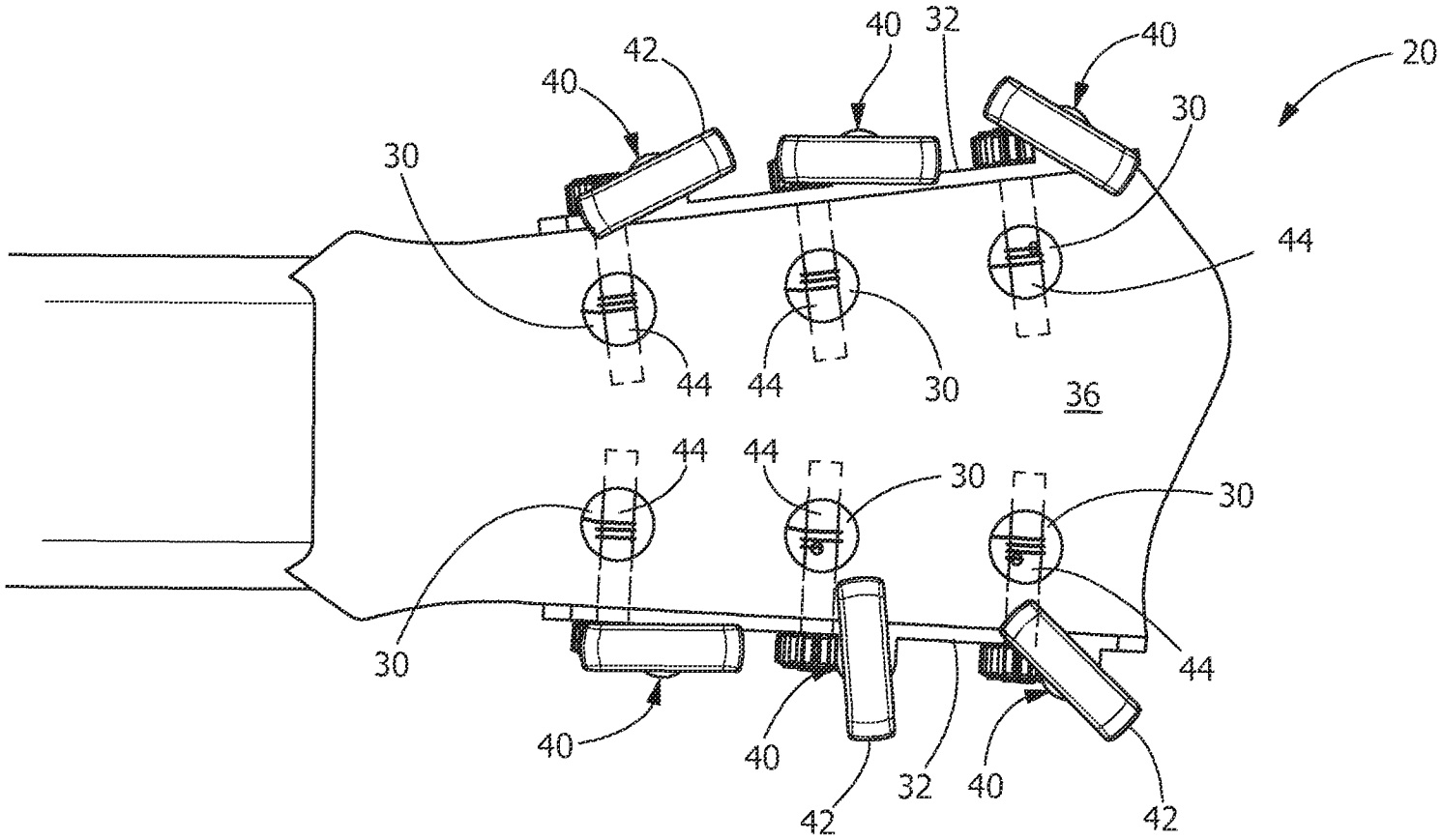
FIG. 3 is a bottom view of the headstock of FIG. 1.

The headstock 20 is adapted to secure the distal end of each string 24. For this purpose, the headstock 20 is formed with a plurality of openings 30 which extend through the headstock 20, typically transversely through the headstock 20. As shown in FIGS. 1-3, the openings 30 may be arranged proximate to the sides 32 of the headstock 20. The configuration of the openings 30 facilitates the separation between the ends of the strings 24 and to orient the strings 24 relative to the nut 22. This arrangement is merely illustrative and other arrangements may be substituted as long as the separation between strings 24 is accomplished.

The openings 30 extend from a top or first surface 34 of the headstock 20 to a bottom or second surface 36 of headstock 20. In the illustrative embodiment shown, the longitudinal axis of each opening 30 is approximately perpendicular to the longitudinal axis of the headstock 20. However, the openings 30 may be angled through headstock 20 at different angles without departing from the scope of the invention. For example, the openings 30 may extend at an angle of about 30 degrees, 45 degrees or 60 degrees with the bottom side 36 of headstock 20. In addition, the different openings 30 may extend at different angles.

Figure 4:
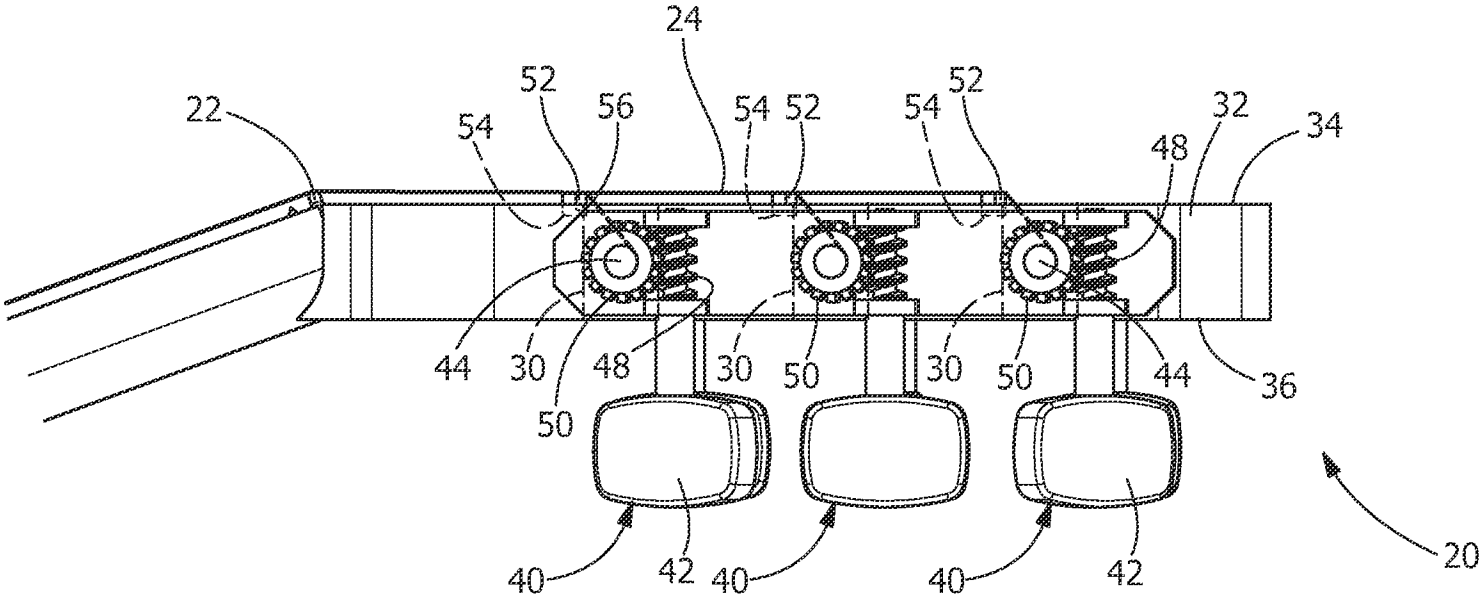
FIG. 4 is a side view of the headstock of FIG. 1.
Figure 5:
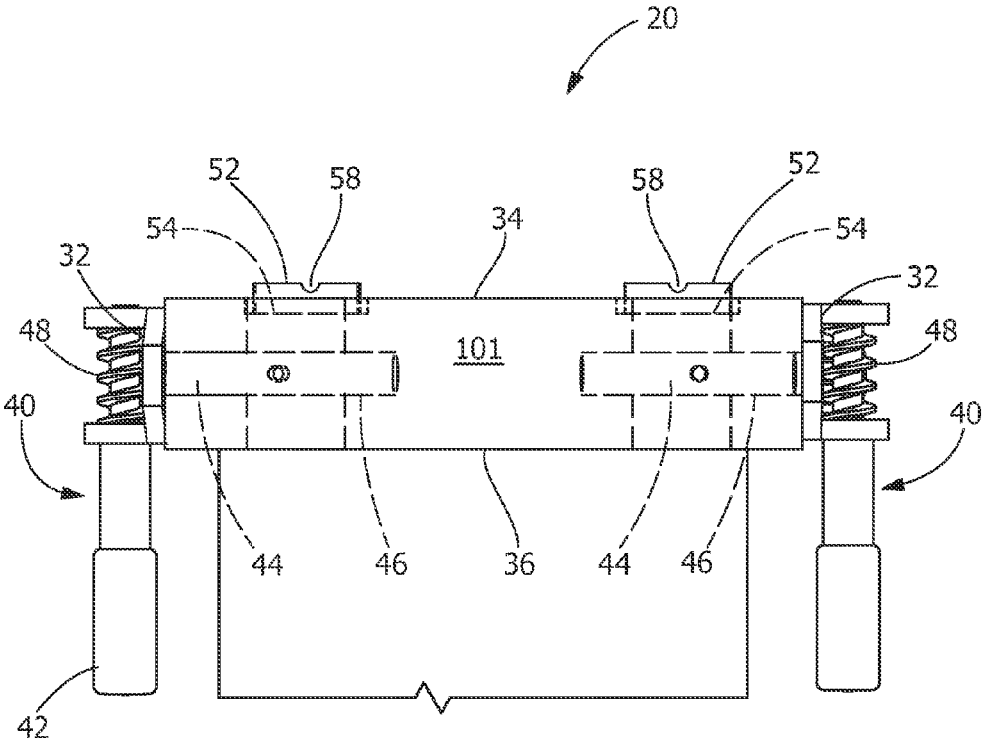
FIG. 5 is an end view of the headstock of FIG. 1.

The headstock 20 includes side mount tuner mechanisms 40 which are mounted through the sides 32 of the headstock 20. Each tuner mechanism 40 includes a tuner tension adjustment member 42 and a shaft or post 44. As best shown in FIGS. 4 and 5, the posts 44 extend through post receiving openings 46 which extends at least between the openings 30 and the sides 32 of the headstock 20. The posts 44 which are movably attached to the tuner tension adjustment members 42 are inserted into the post receiving openings 46. The tuner mechanisms 40 may be retained in this position by attachment members, such as, but not limited to, auxiliary screws (not shown). In this fully inserted position 14, the posts 44 are positioned in the openings 30 and extend in a direction substantially transverse to the longitudinal axis of the openings 30. Small openings or recesses (not shown) may be provided the portions of the posts which are positioned in the openings 30. The openings or recesses are provided to cooperate with the strings 24, as will be more fully described.

In the embodiment shown and as best shown in FIGS. 4 and 5, the tuner tension adjustment member 42 has threads 48 and the posts 44 have projections 50. The threads 48 engage the projections 50, such that as the tuner tension adjustment member 42 is turned, the threads 48 turn the projections 50 to turn the posts 44. Other mechanisms may be provided on the tuner tension adjustment member 42 and the posts 44 to allow the posts 42 to turn in response to the turning of the tuner tension adjustment member 42. Such mechanisms include, but are not limited to, circular gear type members.

As best shown in FIGS. 1-4, the headstock 20 has saddles 52 which are positioned in saddle receiving recesses and extend past the top surface 34 in a direction away from the bottom surface 36. The saddles may be made from wood, plastic, bone, ivory or any other material that has the strength and acoustic characteristics required. In the embodiment shown, the saddles 52 have a dimension of 3/32" wide by 5/8" long by 7/16" high. However, other shapes and sizes can be used without departing from the invention.

The saddle receiving slots or recesses 54 are provided proximate each opening 30. The saddle receiving recesses 54 are positioned between the openings 30 and the nut 22. The saddle receiving recesses 54 are dimensioned to receive the saddles 52 therein. The saddles 52 may be retained in the recesses 54 by frictional engagement, adhesive or other know methods. In the embodiment shown, the saddle receiving recesses 54 have a dimension of 3/32" wide by 5/8" long by 1/4" deep. However, other shapes and sizes can be used without departing from the invention.

Spacing between the openings 30 and the saddle receiving recesses 54 may vary. Depending upon the spacing between the openings 30 and the saddle receiving recesses 54, slots or grooves 56 may be provided in the top surface 34 of the headstock 20 proximate the openings 30 to allow the strings 24 to be extend from the saddles 52 into the openings 30 without engaging the top surface 34 of the headstock 20.

As best shown in FIG. 5, slots 58 may be provided in the saddles 52. The slots 58 are optional and are used when the saddles 52 are used to direct the path of the string 24. In addition, the slots 58 prevent lateral movement of the strings 24. The slots 58 may be used alone or in conjunction with other string guides (not shown).

In use, the strings 24 are strung from the body of the guitar and are threaded vertically over the saddles 52 in into openings 30. This positions the strings 24 to extend horizontally over the saddles 52 and nut 22. The ends of the strings 24 attach to the posts 44 in the typical manner. If the posts 44 having a small openings or recesses, the string may be initially positioned therein to facilitate the placement of the strings 24 on the posts 44. The saddles 52 cooperate with the strings 24 to provide a path to the nut 22 while preventing the string 24 from coming in contact with the headstock 20. Depending upon the configuration of the headstock 20 and the angle of the headstock 20 relative to the neck, the saddles 52 height can be adjusted to provide optimal clearance of the string 24. The saddles 52 may be adjusted, for example, by removing material from the bottom of the saddle that is seated in the saddle slot 54.

The use of the saddles 52 and saddle receiving recesses 54 allow the strings 24 to be properly positioned with the need to have longitudinal slots which extend over a significant length of the headstock, as is typically done in the art. The elimination of the longitudinal slots allows the headstock to be stronger and have greater structural integrity. Consequently, the headstock 20 of the present invention is less vulnerable to damage from side impacts.

The use of the saddles 52 and side mount tuner mechanisms 40 allows the headstock 20 to be made in shape and sizes that are not available using known methods. The positioning of the openings 30 and strings 24 in the headstock 20 is also unlimited, as the saddles 52 and saddle receiving recesses 54 may be positioned anywhere on the headstock 20 without affecting the structural integrity of the headstock 20.

The headstock 20 may be used with any number of strings, including, but not limited to, 6 or 8. The headstock 20 may be straight or angled relative to the neck.

The tuner mechanism 40 exerts a positive down tension on the strings 24 as it travels over the string guide or nut 22 due to the inset position of the post 44 of the tuner mechanism 40 in the headstock 20, thereby eliminating the need for any ancillary string tensioning devices.

The use of saddles 52 and saddle receiving recesses 54 provides at least the advantages recited above without adversely affecting the pitch of strings 24 or the overall performance of the instrument. The tuning of the strings 24 is done in a conventional manner with no need for additional tooling.

While the invention has been described with reference to an illustrative, preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A headstock for use with a stringed instrument, the headstock comprising:

saddle receiving recesses positioned proximate openings which extend through a first surface of the headstock toward a second surface of the headstock;

saddles positioned in the saddle receiving recesses, the saddles extend past the first surface in a direction away from the second surface;

wherein the saddles and saddle receiving recesses cooperate with strings of the stringed instrument to direct the path of the strings.

2. The headstock as recited in claim 1, wherein the saddles are retained in the saddle receiving recesses by frictional engagement.

3. The headstock as recited in claim 1, wherein the saddles are retained in the saddle receiving recesses by adhesive.

4. The headstock as recited in claim 1, wherein slots are provided in the saddles, wherein the slots prevent lateral movement of the strings.

5. The headstock as recited in claim 1, wherein grooves are provided in the first surface of the headstock between the openings and the saddle receiving recesses, wherein the grooves allow the strings to be extend from the saddles into the openings without engaging the first surface of the headstock.

6. The headstock as recited in claim 1, wherein the openings extend from the first surface of the headstock to the second surface of headstock.

7. The headstock as recited in claim 6, wherein a longitudinal axis of each of the openings is approximately perpendicular to a longitudinal axis of the headstock.

8. The headstock as recited in claim 1, wherein tuner mechanisms are provided on the headstock, the tuner mechanisms extend into the openings to cooperate with the strings.

9. The headstock as recited in claim 8, wherein the tuner mechanisms include tuner tension adjustment members and posts, the posts are positioned in the openings, the posts are movably attached to the tuner tension adjustment members.

10. The headstock as recited in claim 9, wherein the tuner tension adjustment member has threads and the posts have projections, the threads engage the projections, wherein as the tuner tension adjustment member is turned, the threads turn the projections to turn the posts.

11. The headstock as recited in claim 8, wherein the tuner mechanisms are mounted through sides of the headstock.

12. The headstock as recited in claim 1, wherein the stringed instrument is a guitar.

13. A headstock for use with a stringed instrument, the headstock comprising:

saddle receiving recesses positioned proximate openings which extend through a first surface of the headstock toward a second surface of the headstock;

saddles positioned in the saddle receiving recesses, the saddles extend past the first surface in a direction away from the second surface;

tuner mechanisms extending into the openings to cooperate with strings of the stringed instrument;

wherein the saddles and saddle receiving recesses cooperate with the strings to direct the path of the strings.

14. The headstock as recited in claim 13, wherein slots are provided in the saddles, wherein the slots prevent lateral movement of the strings.

15. The headstock as recited in claim 13, wherein grooves are provided in the first surface of the headstock between the openings and the saddle receiving recesses, wherein the grooves allow the strings to be extend from the saddles into the openings without engaging the first surface of the headstock.

16. The headstock as recited in claim 13, wherein the tuner mechanisms include tuner tension adjustment members and posts, the posts are positioned in the openings, the posts are movably attached to the tuner tension adjustment members.

17. The headstock as recited in claim 13, wherein the tuner mechanisms are mounted through sides of the headstock.

18. A headstock for use with a stringed instrument, the headstock comprising:

saddle receiving recesses positioned proximate openings which extend through a first surface of the headstock toward a second surface of the headstock;

saddles positioned in the saddle receiving recesses, the saddles extend past the first surface in a direction away from the second surface;

tuner mechanisms extending into the openings to cooperate with strings of the stringed instrument, the tuner mechanisms mounted through sides of the headstock;

wherein the saddles and saddle receiving recesses cooperate with the strings to direct the path of the strings.

19. The headstock as recited in claim 18, wherein slots are provided in the saddles, wherein the slots prevent lateral movement of the strings.

20. The headstock as recited in claim 18, wherein grooves are provided in the first surface of the headstock between the openings and the saddle receiving recesses, wherein the grooves allow the strings to be extend from the saddles into the openings without engaging the first surface of the headstock.

* * * * *